United States Patent [19]

Bowman et al.

[11] 3,931,701

[45] Jan. 13, 1976

[54] AUTOMATIC PRODUCE-BAGGING MACHINE THAT USES FACTORY-ROLL POLYETHYLENE NET TUBING

[75] Inventors: Earl K. Bowman; John C. Teele, both of Gainesville, Fla.

[73] Assignee: The United States of America as represented by the Secretary of Agriculture, Washington, D.C.

[22] Filed: Mar. 28, 1975

[21] Appl. No.: 563,256

Related U.S. Application Data

[63] Continuation-in-part of Ser. No. 484,198, June 28, 1974, abandoned.

[52] U.S. Cl. ..... 53/59 R; 53/183

[51] Int. Cl.[2] ..... B65B 57/10; B65B 43/00

[58] Field of Search ..... 53/59 R, 183

[56] References Cited

UNITED STATES PATENTS 2,847,806 8/1958 Wang ..... 53/183 X 3,812,642 5/1974 Mintz et al. ..... 53/183 X

*Primary Examiner*—Travis S. McGehee

*Attorney, Agent, or Firm*—M. Howard Silverstein; Max D. Hensley

[57] ABSTRACT

A produce-bagging machine utilizing factory-roll polyethylene net tubing for automatic packaging is described. The bagging machine is designed to form bags from factory rolls of polyethylene net tubing, fill the bags with produce, and close and eject them in a continuous automatic cycle. The machine consists of seven main parts: (1) an opening and gripping mechanism, (2) a bottom-closing and cutting mechanism, (3) a filling device, (4) a top-closing mechanism, (5) an ejection chute, (6) automatic action controls, and (7) a spreading mechanism.

6 Claims, 19 Drawing Figures

(DETAIL A)

AUTOMATIC PRODUCE-BAGGING MACHINE THAT USES FACTORY-ROLL POLYETHYLENE NET TUBING

This is a continuation-in-part of application Ser. No. 484,198, filed June 28, 1974, now abandoned.

PRIOR ART AND BACKGROUND OF THE INVENTION

Oranges and grapefruit have been packaged in bags at the shipping point for more than three decades in Florida. For about 20 years it was all done manually. Only fabric mesh bags were used before polyethylene film bags, which first appeared in Florida statistics for the 1958–1959 season. Polyethylene net bags first appeared in Florida statistics for the 1966–67 season.

In Florida most citrus bagging in polyethylene film bags is done by semiautomatic machinery: limited automatic machines are in use. In all semiautomatic bagging operations, purchased (premanufactured) bags are used entirely. The semi-automatic equipment used by the larger portion of the packinghouse counts the desired quantity of fruit into the bag upon actuation of a foot pedal or other control by the operator. The operator holds the bag in position to catch the fruit, then closes it by a tape or stapling device, and places it in a master carton. Similar semiautomatic equipment is used elsewhere for packaging such produce as apples, onions, and potatoes in polyethylene film bags. Generally, this equipment measures quantity by weight instead of count. Machine action or the operator pours the measured quantity from a pan or accumulating chamber into the bag after the machine feed has stopped at a preset weight. Bag closing practices are similar to those employed on semiautomatic citrus bagging operations. Semiautomatic machines suitable for polyethylene film bags are also generally usable for bagging fruit in polyethylene net bags.

Automatic polyethylene film bagging machines have been installed in several Florida packinghouses over approximately the past three years. Premade bags are used by all of them except for one make that uses specially prepared film, doubled, in a ribbon with perforations in heat-sealed strips betweem bags. The bagging machine heat-seals the top after filling except where twist-tie or Kwik-lok closing has been substituted. Bags separate along perforation lines in passing out of the machine onto the takeaway conveyor. Manual checking of bag weight is required in operating one make of these machines, a carrousel type.

No fully automatic machines are available for handling polyethylene net bags except one type, recently offered in the Florida citrus area, with an attachment for automatically handling net bags supplied on wire frames. Thus far, the tooling of bagmakers has not provided for supplying polyethylene net bags in this way. Since manufactured polyethylene net bags cost about twice as much as film bags, there would be an economic as well as many other advantages accruing to consumers and packers alike by having bag forming incorporated into an automatic cycle of bag filling and closing machinery.

These concepts were emperically tested and evaluated by constructing an experimental machine. Testing of the machine was confined to packing 5-pound bags of oranges because of their lead in shipment of Florida citrus fruit in polyethylene net bags. The machine is adaptable, however, to other bag sizes, produce, and applications.

OBJECTIVES

One of the objectives of this machine is to eliminate the need for preformed bags. Another objective is to make a totally automatic citrus bagging machine. Another objective is to incorporate the bag forming into the automatic cycle. It is yet another objective to eliminate the need for manual labor in any of the weighing and bagging operations of citrus packaging. Another object of this invention is to reduce the cost of packaging of citrus fruits. Still another object of this invention is to supply a means of packaging other types of produce.

GENERAL DESCRIPTION OF THE INVENTION

Polyethylene bagging material is initially manually fed into the automatic bag-forming portion of the automatic bagging machine when a new roll of netting is installed. This is done by hand feeding the netting material through the bottom ring around the spreading mandrel, thus positioning it to begin the automatic bag-forming operation.

The solenoid actuates the spreader thereby positioning it to subsequently spread the netting by allowing for entry of the spreading fingers in the gripping head. The spreading fingers of the gripping head are positioned to the center of the cross head thereby enabling the cross head to be lowered in such a manner that the fingers are inserted into the center of the polyethylene netting material. The fingers contact the top of the spreading mandrel causing the top of the spreading mandrel to be repositioned. The gripping fingers are then actuated to an out position thus opening the top of the netting material to allow for produce entry. The cross head then moves up the full length of a bag (approximately 19 inches) pulling the netting material with it.

Then the bottom gathering, closing, and cutting mechnism swings in. The bottom gathering arm gathers the material and after gathering the material it actuates a micro switch which staples and then cuts the bag thus forming the bottom of the bag. The bottom gathering, closing and cutting mechanism then swing out and simultaneously the chute drops down to support the fruit which is then going to automatically be counted into the open bag.

The automatic counter then counts the desired amount of produce into the bag, as previously programmed (approximately 11 to 13 oranges). This can be any amount of fruit or produce which can be programmed for bagging. After counting the produce into the bag the counting machine signals the bagging machine to start closing the top again.

The gripping belts enter under the gripping head. The gripping belts have two arms which forces the hot wire in. The hot wire then cuts the netting off the gripping fingers. Then actuate the belt and move the net into the top closing mechanism. When the net moves into the top closing mechanism far enough it signals the photoelectric cell (triggers the photoelectric cell). The photoelectric cell actuates the gathering arm and causes the gathering arm to move in and gather the material (polyethylene material). When the material has been gathered, the micro switch is actuated thereby actuating the stapling mechanism. The stapling mechanism then staples the material together at the top and simultaneously the chute pan automatically moves up into position to allow the bag to slide forward and down. It is thus ejected. The machine then repeats the same operations previously described.

DETAILED DESCRIPTION OF INVENTION

In describing the preferred embodiment of the invention illustrated in the drawings, specific terminology will be resorted to for the sake of clarity. However, it is not intended to be limited to the specific terms so selected, and it is to be understood that each specific term includes all technical equivalents which operates in a similar manner to accomplish a similar purpose. Machine dimensions, materials of construction, control devices, operating configurations and applications illustrated are typical only and all other more sophisticated equivalents are also intended.

Figure 6:
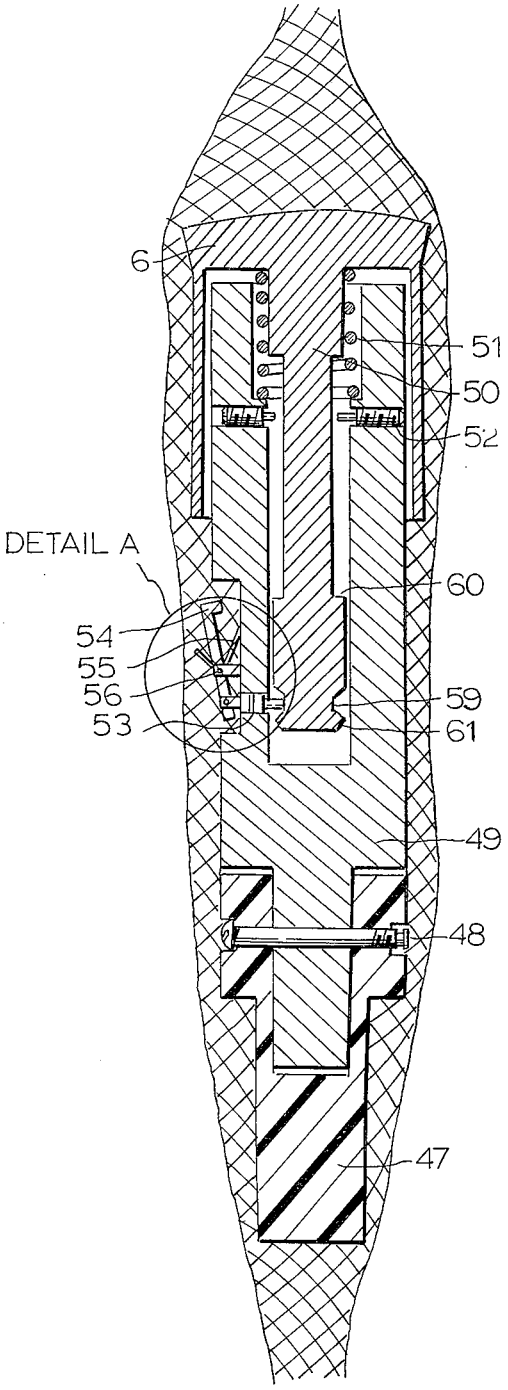
FIG. 6 is an illustrative cross-sectional drawing of the spreading mandrel in the down or collapsed position.
Figure 7:
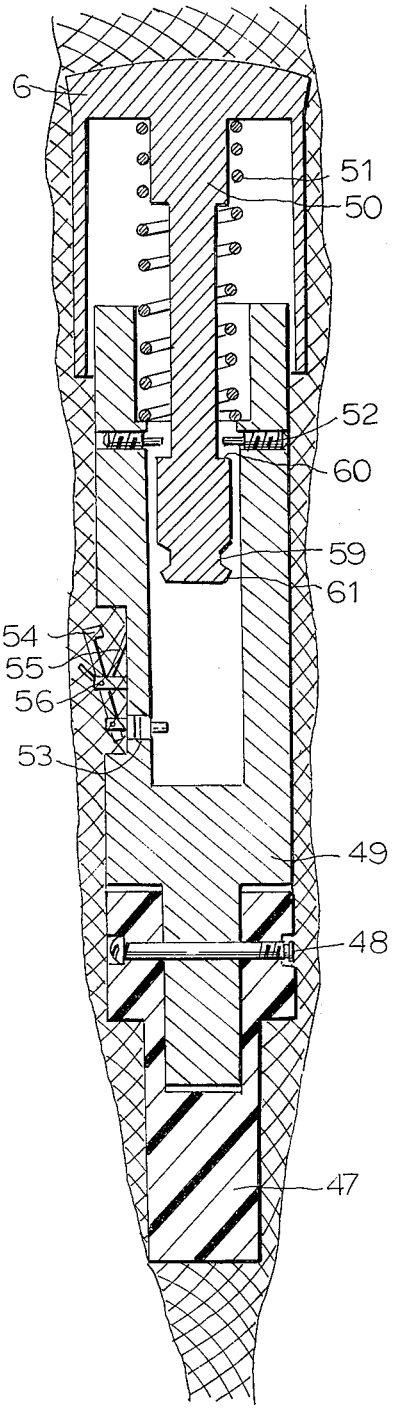
FIG. 7 is an illustrative cross-sectional view of the spreading mandrel in the expanded or up position.
Figure 12:
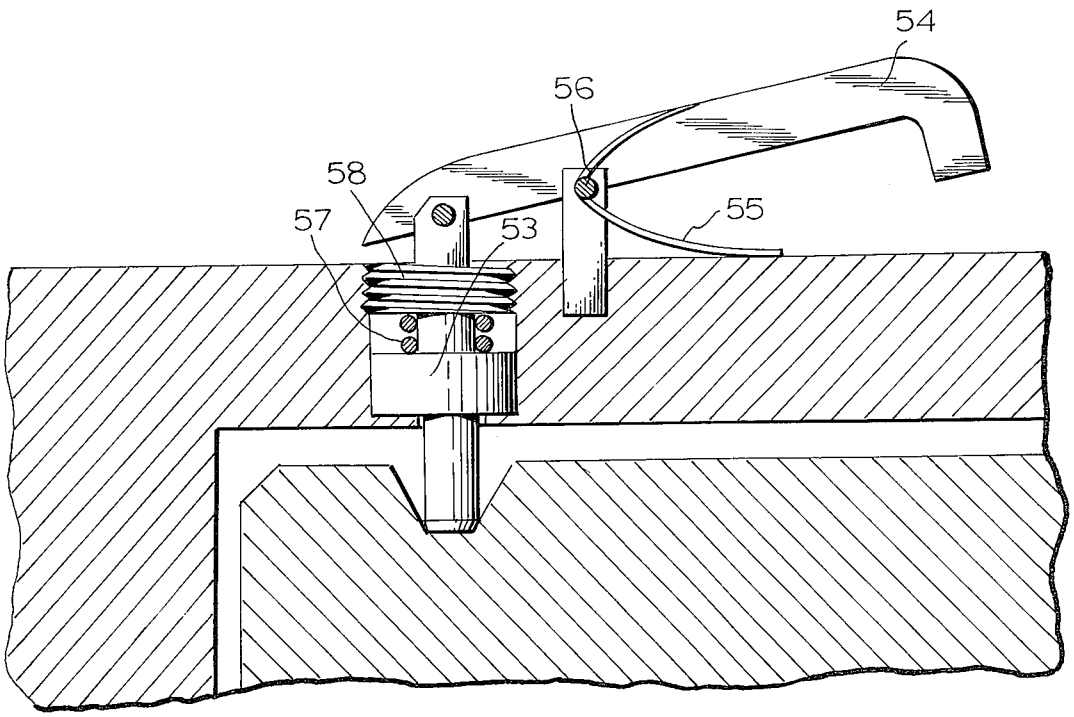
Figure 13A:
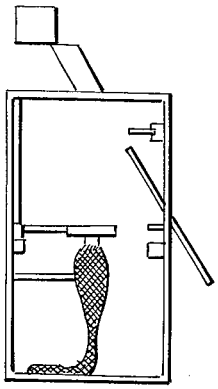
Figure 13B:
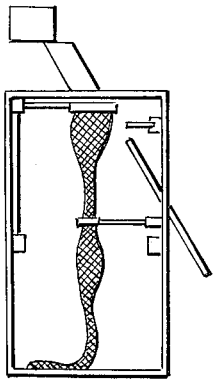
Figure 13C:
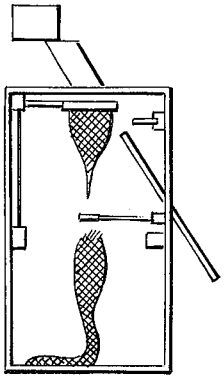
Figure 13D:
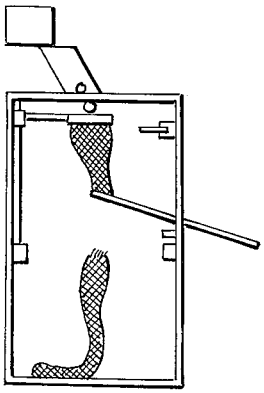
Figure 13E:
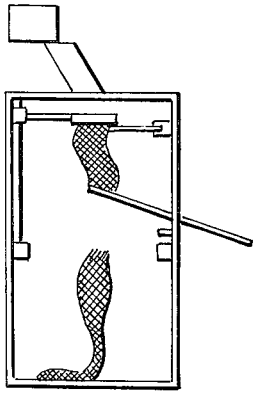
Figure 13F:
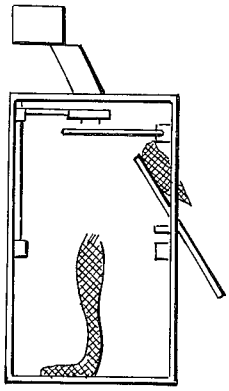
Figure 13G:
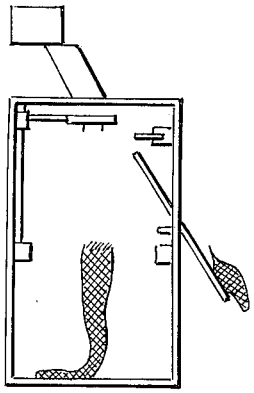

FIG. 12, Detail A is a detail of the internal workings with respect to FIGS. 6 and 7.

FIG. 13, A through G, is an illustrative cross-sectional view of the machine action sequences.

Figure 1:
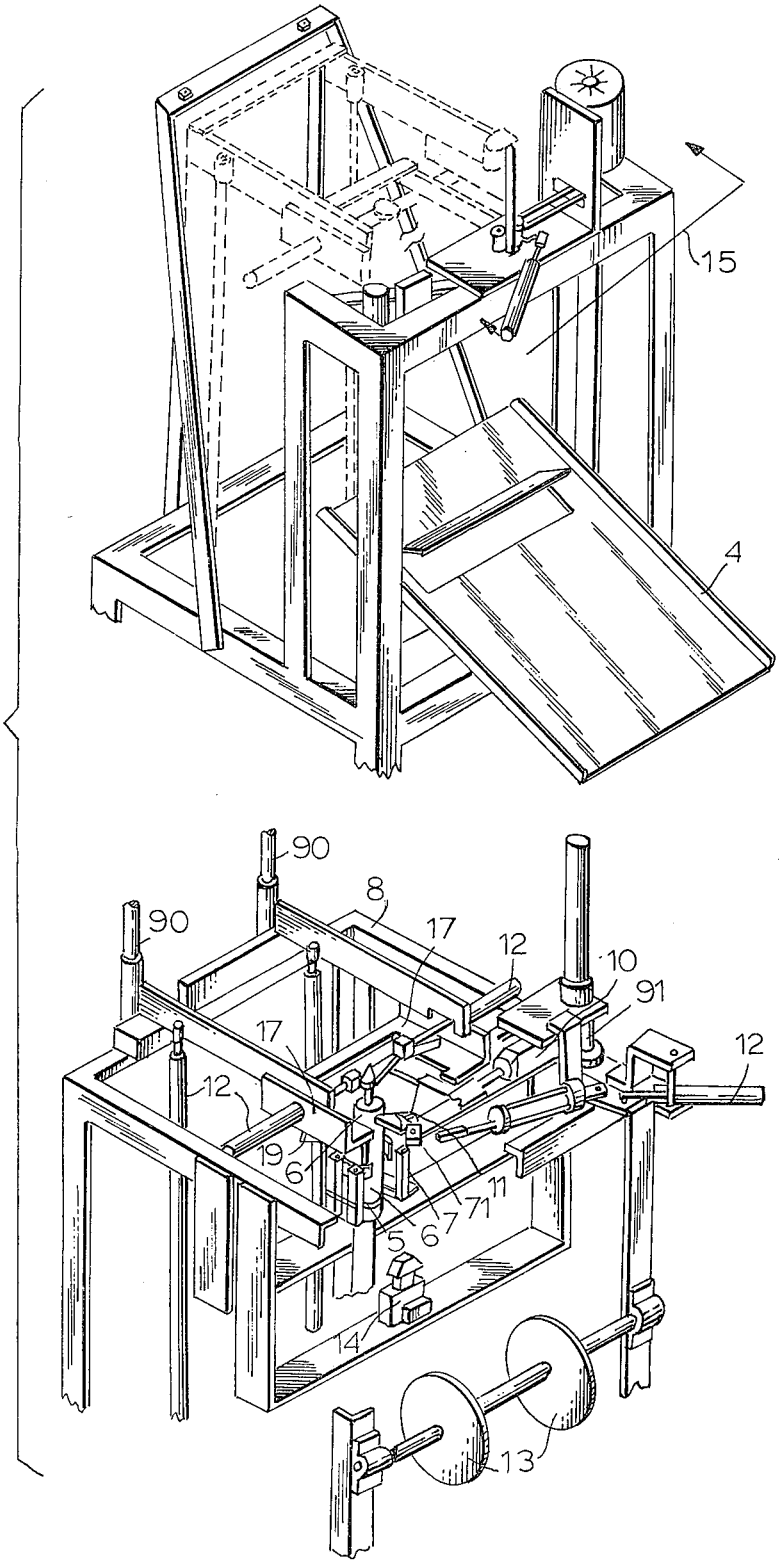
FIG. 1 is an exploded isometric view showing the bagging machine.
Figure 5:
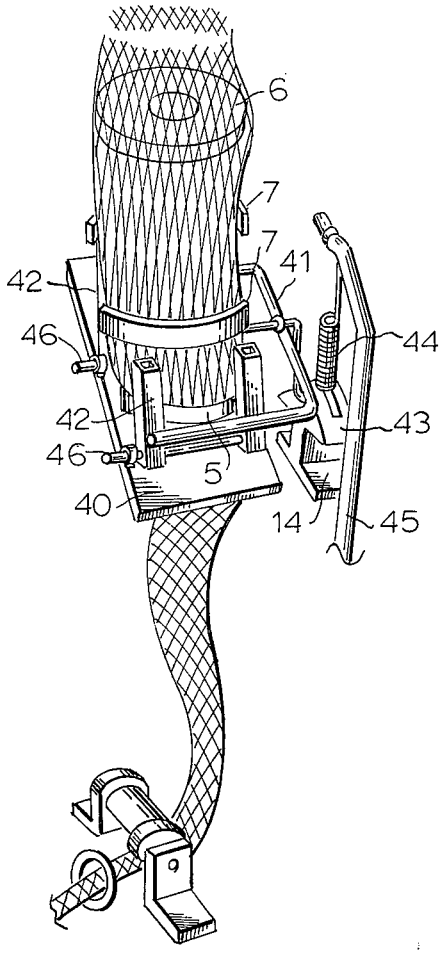
FIG. 5 is an isometric view of the spreading mandrel and the tripping mechanism with the polyethylene net tubing superimposed over the exterior.

In the preferred embodiment of the invention, polyethylene net tubing is supplied by the manufacturer on a roll in continuous form. Reference is made to FIGS. 1 through 12. The end of the polyethylene net tubing on roll 13, FIG. 1, is manually fed into the automatic bag forming machine by inserting the net material through base plate 40 and ring 5, and around spreading mandrel 6, FIGS. 1, 2, and 5, thus positioning it to begin the automatic bag-forming cycle. Spreading mandrel 6, FIGS. 5, 6, and 7, is of a cylindrical design and floats free inside ring 5, which is mounted to base plate 40. FIG. 5. Base plate 40 has a hole for the polyethylene net tubing to pass through. This hole is smaller than the circumference of the mandrel thus holding the mandrel in place above the base plate.

The trippers 7, FIG. 5, are actuated by the solenoid 14, positioning the spreading mandrel 6, FIGS. 5, 6, and 7, to subsequently spread the netting and allow for entry of the opening and gripping mechanism 8, FIGS. 1, 2, 3, and 4. The spreader mandrel operates as follows:

Solenoid 14, FIG. 5, connected to tripper 7, which pivots on screw 46, and is mounted on frame 42, attached to plate 40, by rod 41, actuates tripper 7 which pivots at base plate 40 and comes into contact with locking pin arm 54, FIG. 6, pulling locking pin 53, FIG. 6, up and out of locking groove 59, thereby releasing the top of the spreader mandrel 50, to be forced upward by spring 51, thus resulting in expanded position as shown in FIG. 7. Simultaneously, locking pin spring return 57, FIG. 12, detail A, forces locking pin 53 back into ready position. The expanded position is fixed by the top mandrel locking shoulders 60, contacting with locking screws 52, FIGS. 6 and 7. This position is necessary to receive the gripping mechanism of the automatic bagging machine.

Simultaneously, trippers 7, FIG. 5, are returned to resting position by return spring 44, which is attached to return spring anchor mount 45, which is attached to solenoid 14, FIG. 5.

A cam timer on the automatic bagging machine signals a gripping mechanism which is part of the bagging machine bringing the gripping mechanism into contact with the top of the spreader mandrel 50, FIG. 6, forcing the top of spreader mandrel 50, FIGS. 6 and 7, downward. As top spreader mandrel 50, is forced downward, the bevel on the top internal pop-up section 61, contacts locking pin 53, shoves it outward, and allows pin 53 to insert into groove 50, thereby repositioning and resetting spreader mandrel 6, as shown in FIG. 6, which is the initial starting position. The polyethylene netting material can then slide between the exterior surface of spreader mandrel 6, FIG. 5, and stationary guide ring 5, FIG. 6.

Figure 3:
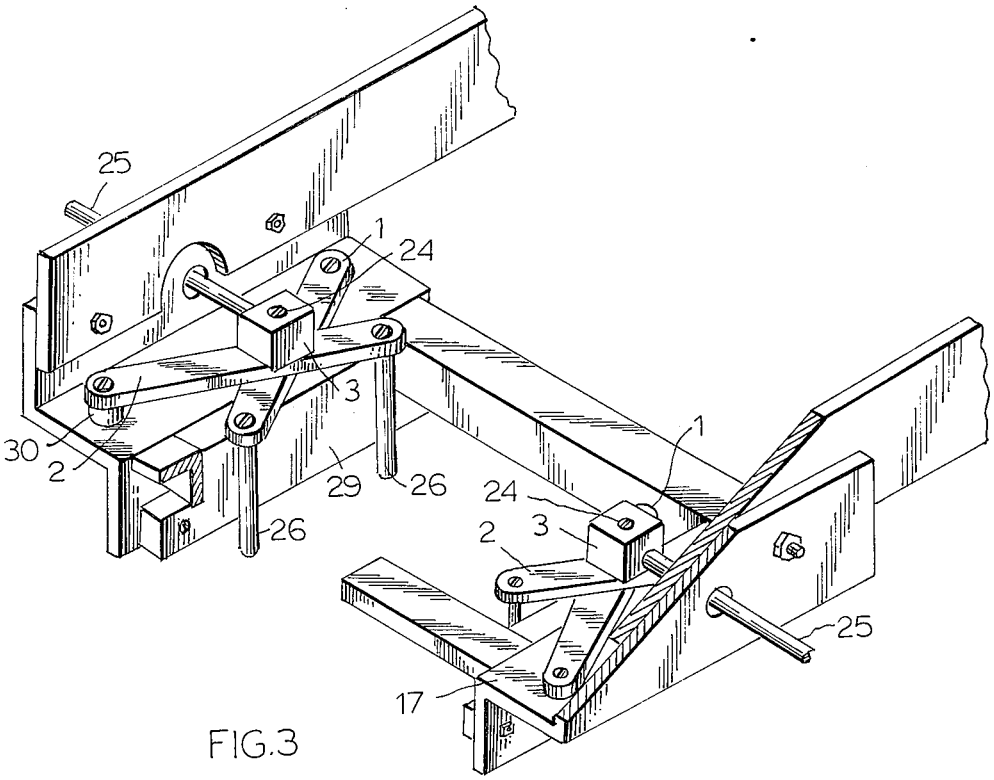
FIG. 3 is an isometric view of the gripping fingers in the spread open position.
Figure 4:
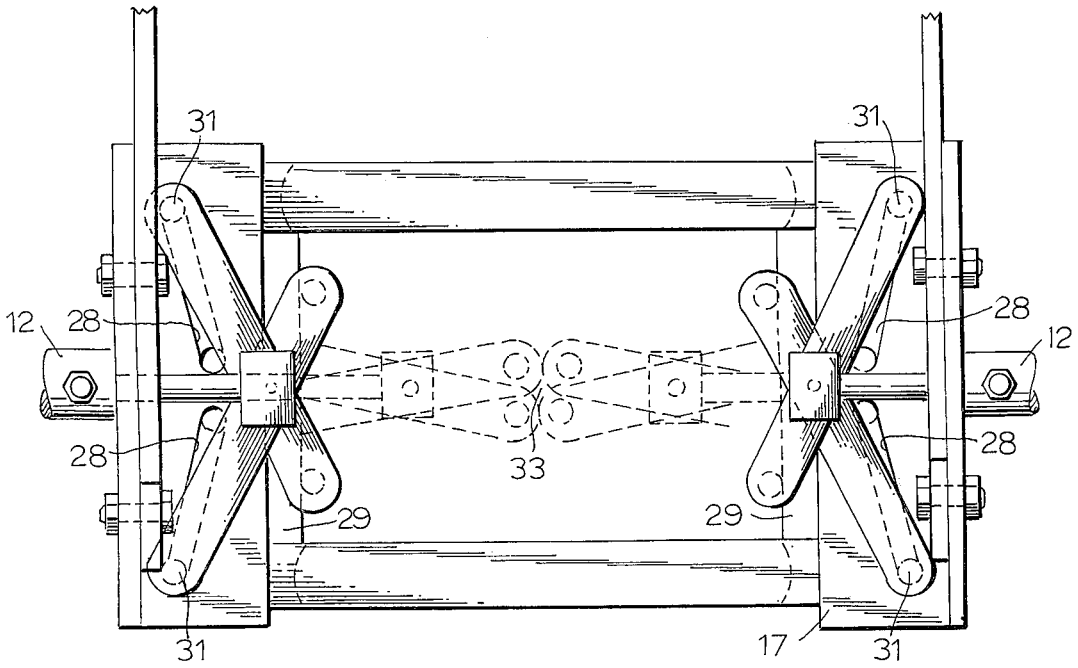
FIG. 4 is an illustrative drawing showing the position of the gripping fingers in both the open and closed position.

The opening and gripping mechanism 8, is then positioned to the center of the cross-head which is then lowered in such a manner that the fingers of the opening and gripping mechanism 8 are inserted into the center of the polyethylene netting material. This position of sequence is represented on sequencing graft 13 as sequence 13 A. Opening and gripping mechanism 8 is attached to cross-head frame 17 which is mounted to vertical rods 90 which are rigidly mounted to the outer frame for support. The cross-head 17 thus moves up and down guided by vertical rods 90 for vertical movement and alignment. Gripping fingers 26, FIG. 3, move in and out actuated by air cylinders 12 for horizontal movement, FIGS. 1, 2, 3, and 4. The opening and gripping mechanism operates as follows:

Air cylinders 12 are attached to cylinder rod 25, FIG. 3, which is attached to pivot block 3, using connecting screw 24, which is attached to cross members 1 and 2. The forward ends of cross members 1 and 2 have cylindrical vertical gripping fingers 26 attached at 90° angles to said cross members 1 and 2. The aft end of cross members 1 and 2 are secured by slide action bushing 31, FIG. 4, and a screw through the cross member. Cross member 2 has a spacer 30, FIG. 3, on the secured aft end. This spacer 30 is slightly thicker than the cross member 1. It is the function of this spacer to allow for horizontal leveling of cross member 2.

Since it is the basic function of the gripping surfaces to grip and hold the polyethylene bagging in place during the automatic machine cycle, this operation takes place as follows: air cylinders 12 are actuated forward. This causes cylinder rod 25, FIGS. 3 and 4, to move forward. Since it is attached to pivot block 3 which is attached to cross members 1 and 2 at 2/8 inches forward of the center of the cross bar, the forward end with the gripping fingers 26, FIGS. 3 and 4, moves forward to the center of frame 27, FIGS. 3 and 4, aligning themselves in the entry position 33, FIG. 4. Simultaneously, the aft secured end rides the slide action bushing 31, FIG. 4, along slots 28, FIG. 4, such that the aft ends come together in alignment, thus completing a closing cycle.

The opening cycle takes place by the direct reverse of the operation described above. Air cylinders 12 move rod 25, FIGS. 3 and 4, backward causing gripping fingers 26, FIGS. 3 and 4, to move backward bringing gripping fingers 26 and gripping surface 29, FIGS. 3 and 4, together with the polyethylene net tubing held firmly between fingers 26 and gripping surface 29, FIGS. 3 and 4, thus completing a full open and closing cycle.

The entire gripping head assembly is capable of being lowered and raised during the bag-forming cycle of the automatic bagging machine. In this manner the crosshead is moved upward the full length of a bag (approximately 19 inches) pulling the polyethylene netting material with it, to machine action sequence 13B.

Figure 2:
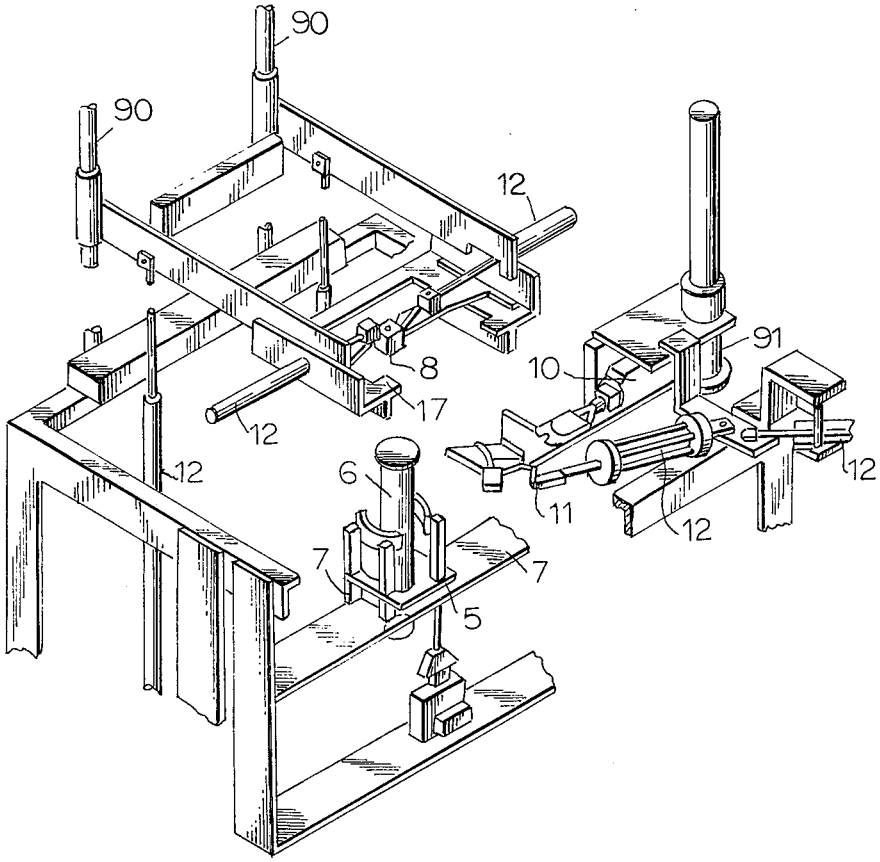
FIG. 2 is an exploded view of the lower portion of the automatic bagging machine detailing the assembly of the opening and closing mechanism and the opening and gripping mechanism in relation to the spreading mandrel.
Figure 11:
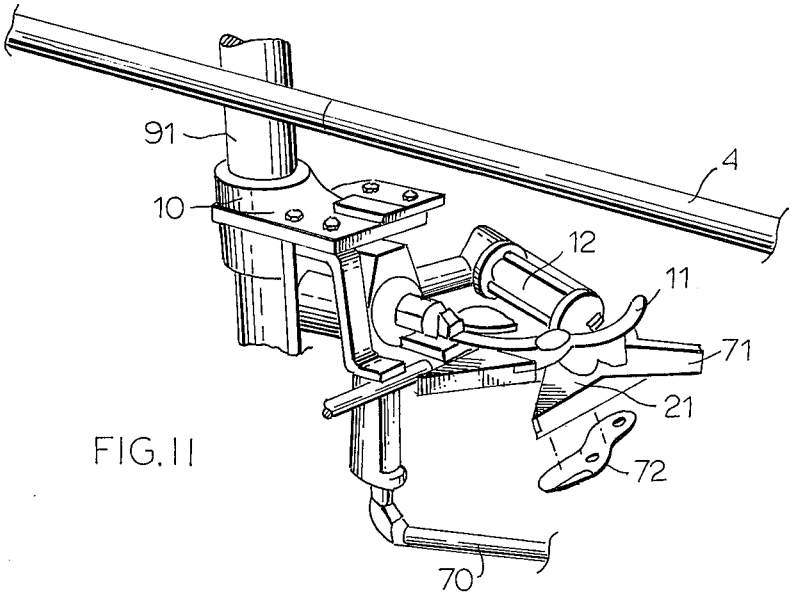
FIG. 11 is an isometric view of the bottom gathering, closing and cutting mechanism.

At this point air cylinders 12, actuates swing mounting and air stapler 10, FIGS. 1, 2, and 11, causing 10 to swing in, to allow for gathering stapling and cutting of the polyethylene net bag and thus form a bottom. The gathering, cutting and stapling apparatus as shown in FIG. 11 is mounted for swinging horizontally on vertical rod 91 which is attached to the supporting frame. A signal to the solenoid opens the air to air cylinder 12 which is a gathering and cutting cylinder, FIG. 11. The gathering arm 70, gathers the polyethylene material into V-notch 21, and microswitch 71, opens the air to the stapler stapling the polyethylene netting forming a closed net at the bottom. Automatically a knife 72 swings under the V-notch 21, severing the polyethylene net just below the stapled netting. Then swing mounting and air stapler 10 swing back out to initial position. Simultaneously, the chute 4, FIGS. 1 and 11, drops down to support the produce which is then counted automatically into the upper open end of the bag (this sequence is represented by machine operation sequence 13D).

Figure 8:
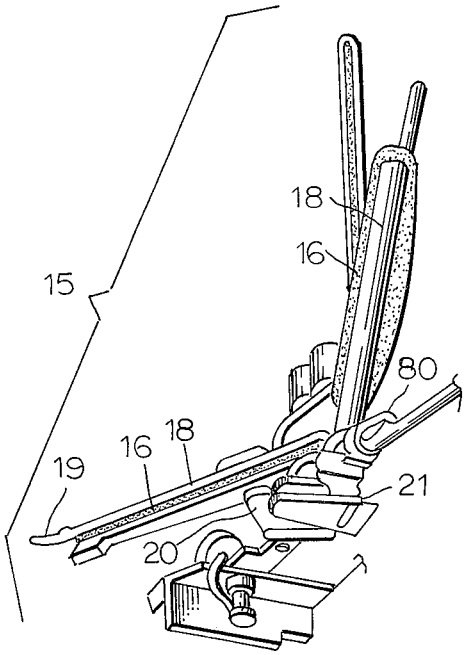
FIG. 8 is an isometric view of the top gathering and closing mechanism.
Figure 9:
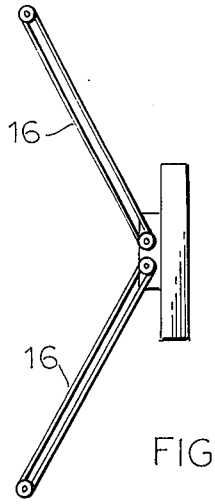
FIG. 9 is an illustrative view of the transfer belt arms in the open position.
Figure 10:
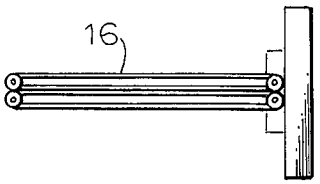
FIG. 10 is an illustrative view of the transfer belt in the closed position.

After counting the produce into the bag, the counting machine (which can be any commerical grade weighing and counting machine) signals the bagging machine to actuate the top gathering and closing mechanism 15 which is swing mounted to the top of the support frame, FIGS. 1 and 8. The gripping belts 16, FIG. 8, enter under the gripping frame 17, FIGS. 1 and 2. The gripping belts have two transfer belt arms 18, FIG. 8, with a hot wire attachment 19, FIG. 8. The transfer belt arms 18, forces the hot wire 19, into contact with the polyethylene netting thus severing the netting from the gripping fingers 8. FIGS. 1 and 8, this point of bag forming is represented by machine diagram sequence 13E. These actuate the gripping belts 16, FIG. 8, and move the net into top closing mechanism 15, far enough to trigger the photoelectric cell 80 which actuates the top gathering arm 20, which gathers and staples the net material by triggering the V-notch stapling mechanism 21, FIG. 8. Simultaneously, the chute pan 4, FIG. 1, automatically moves up into position to allow the bag to slide forward and down, see machine operational sequence FIG. 13F and 13G, thus ejecting it.

The machine then automatically repeats the same operations above described for another cycle thus forming another bag, filling the bag, stapling, and ejecting.

We claim:

1. An automatic produce-bagging machine that uses factory-roll polyethylene net tubing material for bag fabrication and comprising in combination:

a. a frame;
b. a polyethylene net material spreading means;
  1. an actuating means for said spreading means;
c. an opening and gripping means;
  1. an actuating means for said opening and gripping means;
d. a bottom gathering, closing, and cutting means comprising:
  1. a means of imparting swing movement to said closing means;
  2. a means of gathering the polyethylene net material;
  3. a means of cutting said polyethylene material;
  4. a stapling device to staple the polyethylene material and form substantially a closed bottom of a polyethylene net bag;
  5. an actuating means to impart energy to said bottom gathering, closing, and cutting means;
e. a top gathering and closing means comprising:
  1. a gathering means to gather the top of the polyethylene bag;
  2. a cutting means to cut the top edge of the bag even;
  3. a stapling means to close the top edge of the polyethylene netting material and form a closed container for the produce;
  4. an actuating means to impart energy to said top gathering, closing, and cutting means;
f. an automatic counting means to count the produce into the bag; and
g. a means of supplying the polyethylene net material to the automatic bagging machine.

2. An apparatus as defined in claim 1 wherein the spreading means is a vertical sectional cylinder, the bottom of which telescopes into the top portion thereof.

3. An apparatus as defined in claim 1 wherein the actuating means for the spreading means is a solenoid.

4. An apparatus as defined in claim 1 wherein the means of imparting swing movement to the said closing means is an air cylinder.

5. An apparatus as defined in claim 1 wherein the means of gathering the polyethylene material comprises:

a. a metal arm; and
b. a metal plate with a v-notched section which is used for gathering the material.

6. An apparatus as defined in claim 1 wherein the supplying means for supplying the polyethylene net material to the automatic bagging machine is a spool mounted on a horizontal cross bar attached at the two ends to a vertical frame.

* * * * *